US008443516B2

(12) United States Patent
Bhullar et al.

(10) Patent No.: US 8,443,516 B2
(45) Date of Patent: May 21, 2013

(54) PROCESS FOR REFURBISHING CYLINDER ROLLS AND BASES FOR PRINTING MACHINES

(75) Inventors: Raghbir Bhullar, Brampton (CA); Nitin Padhye, Brantford (CA); David R. Campbell, Burlington (CA)

(73) Assignee: Garry Machine Mfg. Inc., Mississauga, Ontario (CA)

( * ) Notice: Subject to any disclaimer, the term of this patent is extended or adjusted under 35 U.S.C. 154(b) by 293 days.

(21) Appl. No.: 12/839,744

(22) Filed: Jul. 20, 2010

(65) Prior Publication Data

US 2011/0083570 A1 Apr. 14, 2011

Related U.S. Application Data

(60) Provisional application No. 61/272,501, filed on Sep. 30, 2009.

(30) Foreign Application Priority Data

Jul. 15, 2010 (CA) ..... 2710691

(51) Int. Cl.
*G03C 5/00* (2006.01)

(52) U.S. Cl.
USPC ..... 29/895.1; 29/895.3; 29/895.32; 492/54; 492/30

(58) Field of Classification Search
USPC ..... 29/895.1, 895, 895.3, 895.32, 402.01, 29/402.06, 402.11, 402.18, 402.19; 492/54, 492/53, 56, 28, 30
See application file for complete search history.

(56) References Cited

U.S. PATENT DOCUMENTS 4,197,798 A 4/1980 Bardin
4,301,727 A 11/1981 Bardin (Continued)

FOREIGN PATENT DOCUMENTS

DE 20228009068 U1 10/2008
EP 1171304 1/2002

(Continued)

OTHER PUBLICATIONS

ISA/CA, International Search Report and Written Opinion for corresponding international application No. PCT/CA2010/001543, mailed Jan. 13, 2011.

(Continued)

*Primary Examiner* — David Bryant
*Assistant Examiner* — Christopher Besler
(74) *Attorney, Agent, or Firm* — Stites & Harbison, PLLC; David W. Nagle, Jr.

(57) ABSTRACT

The present invention relates to a refurbished cylinder roller and a process for refurbishing cylinder rollers for use in printing machines. More particularly, the present invention also relates to a process for refurbishing metallic gravure cylinder rollers by replacing the worn outer plating layers with an extruded and thermally cured electrically conductive polymer material, and thereafter electroplating new outer plating layers thereon, the new plating layers including a new printing image formed therein. The present invention also relates to a refurbished gravure cylinder roller which includes a core member extending along an axial length, an image-carrying layer having a printing image formed therein and arranged circumferentially about the core member, and an electrically conductive intermediate polymer layer arranged between the core member and the image-carrying layer, where the intermediate polymer material has a conductivity selected to permit electro-plating of the image-carrying layer directly thereon.

6 Claims, 5 Drawing Sheets

U.S. PATENT DOCUMENTS

| | | | | |
|---|---|---|---|---|
| 4,391,898 | A | | 7/1983 | Van der velden |
| 4,446,222 | A | | 5/1984 | Kress |
| 4,700,450 | A | * | 10/1987 | Michel ..... 29/527.2 |
| 4,985,301 | A | | 1/1991 | Butters et al. |
| 5,260,166 | A | | 11/1993 | Nazzaro et al. |
| 5,888,701 | A | | 3/1999 | Fan |
| 5,895,806 | A | | 4/1999 | Gajewski |
| 6,000,333 | A | | 12/1999 | Davis |
| 6,063,499 | A | | 5/2000 | Chiang |
| 6,143,386 | A | | 11/2000 | Lorig et al. |
| 6,167,623 | B1 | | 1/2001 | Niemi et al. |
| 6,224,526 | B1 | | 5/2001 | Stimmelmayr et al. |
| 6,314,879 | B1 | | 11/2001 | Siler |
| 6,361,484 | B1 | | 3/2002 | Chen |
| 6,408,754 | B2 | | 6/2002 | Siler |
| 6,742,453 | B1 | | 6/2004 | Borski |
| 7,021,213 | B2 | | 4/2006 | Sampei |
| 7,334,336 | B2 | | 2/2008 | Tan |
| 7,351,512 | B2 | | 4/2008 | Tan |
| 7,462,146 | B2 | | 12/2008 | Nagata |
| 2003/0049377 | A1 | | 3/2003 | Chesnut |
| 2005/0137071 | A1 | | 6/2005 | Cormier |
| 2005/0143239 | A1 | | 6/2005 | Cormier |
| 2005/0143240 | A1 | | 6/2005 | Tan |
| 2005/0202177 | A1 | | 9/2005 | Chesnut |
| 2007/0137506 | A1 | | 6/2007 | Chesnut |

FOREIGN PATENT DOCUMENTS

| | | | |
|---|---|---|---|
| WO | 0059727 | | 10/2000 |
| WO | 2004096569 | | 11/2004 |
| WO | 2009124541 | | 10/2009 |
| WO | 2009124541 | A1 | 10/2009 |

OTHER PUBLICATIONS

EPO, Extended European Search Report in corresponding European application EP 10 81 9775, completed Jan. 14, 2013.

* cited by examiner

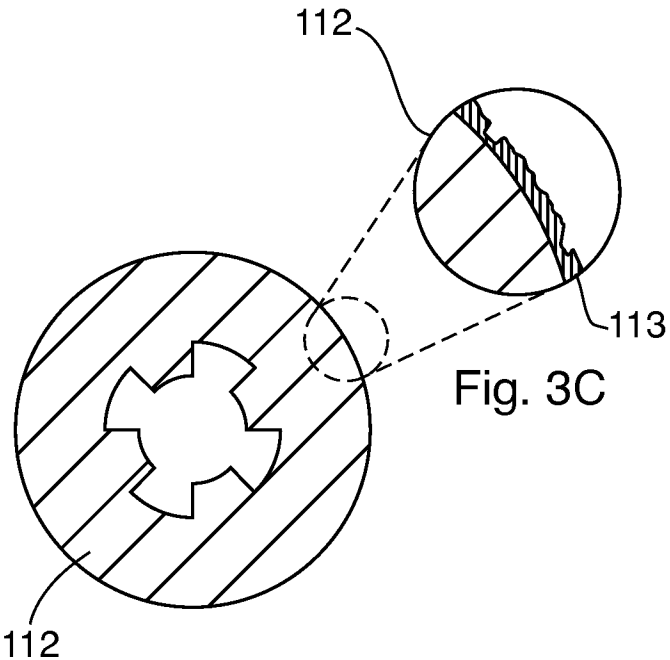
Fig. 3C
Fig. 3B
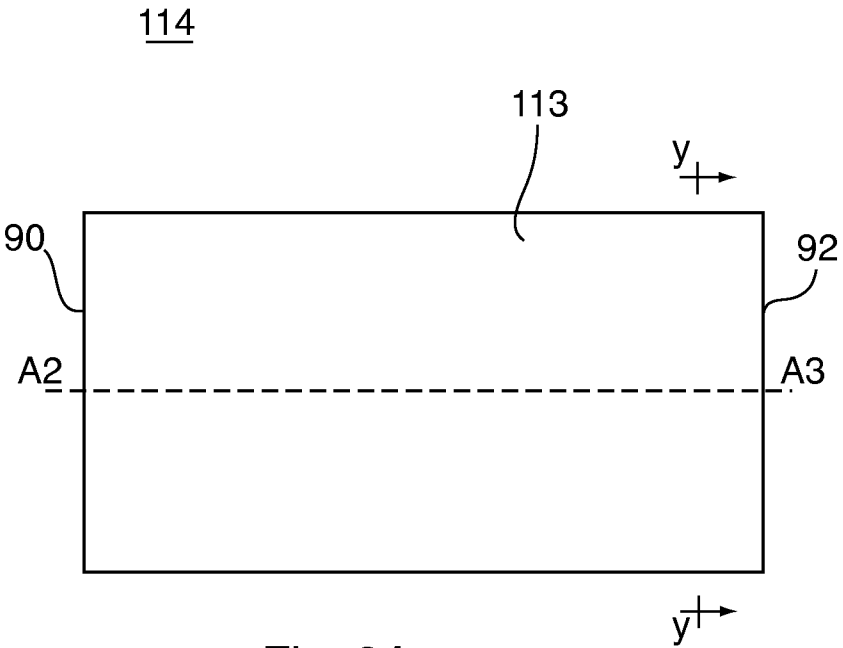
Fig. 3A

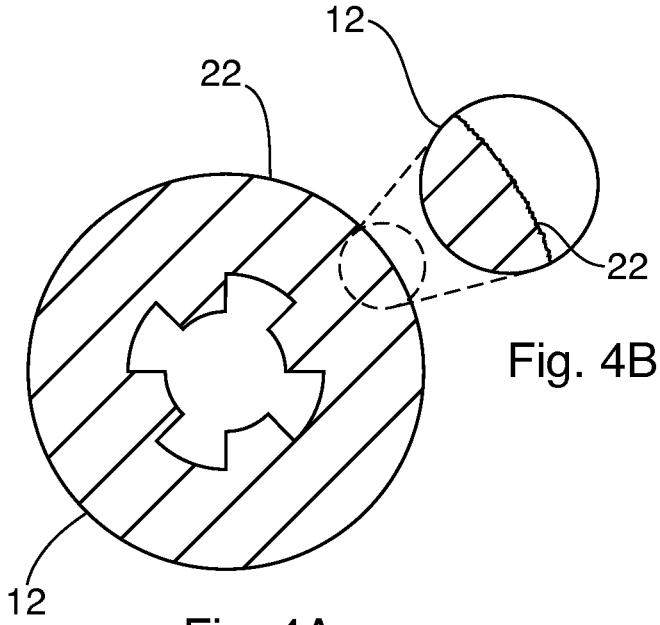
Fig. 4B
Fig. 4A
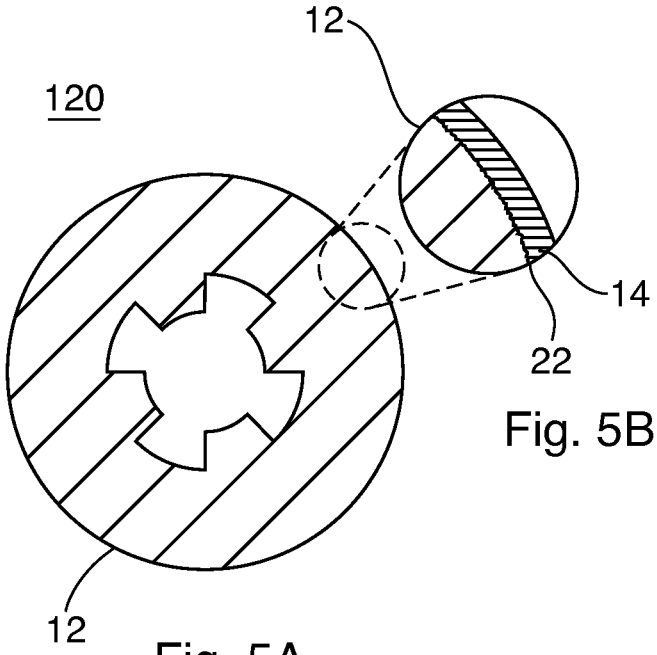
Fig. 5B
Fig. 5A

PROCESS FOR REFURBISHING CYLINDER ROLLS AND BASES FOR PRINTING MACHINES

CROSS-REFERENCE TO RELATED APPLICATIONS

The present application claims priority to U.S. Provisional Patent Application Ser. No. 61/272,501 filed on Sep. 30, 2009 and Canadian Patent Application No. 2710691, also entitled "Process for Refurbishing Cylinder Rolls and Bases for Printing Machines" and filed on Jul. 15, 2010, the entire disclosures of which are incorporated herein by reference.

SCOPE OF THE INVENTION

The present invention relates to a refurbished cylinder roller and a process for refurbishing cylinder rollers for use in printing machines. More particularly, the present invention relates to a process for refurbishing metallic gravure cylinder rollers by replacing the worn outer plating layers with an extruded and thermally cured electrically conductive polymer material, and thereafter electroplating new outer plating layers thereon, the new plating layers including a new printing image formed therein.

BACKGROUND OF THE PRIOR ART

Gravure cylinders or printing rollers used in rotary printing processes generally consist of a cylindrical metallic core on which is electroplated an image-carrying copper layer and a protective outer chrome layer. After a printing run or expected production life of the cylinder roller, it is known to refurbish the cylinder for re-use. Conventionally, gravure cylinders are refurbished by precision grinding the outer surface of the cylinder to remove just the outer image-carrying copper and chrome layers from the metallic core. The copper layer is then reapplied directly onto the metallic core and a new image is engraved or etched into the copper layer. Finally, the outer protective chrome layer is reapplied directly onto the image-carrying copper layer. A difficulty exists with such a refurbishing process in that refurbished cylinders are dimensionally restricted by the outer diameter of the metallic core, such that the refurbished cylinder rollers may not be re-used in applications requiring larger diameters cylinders. Additionally, after successive refurbishments, the cylinder wall of the refurbished cylinder becomes thin, thus reducing the structural integrity of the cylinder.

In an alternative method for refurbishing cylinder rollers after grinding, polyurethane is molded around the metallic core, cured and subsequently sized on a lathe. A ceramic coating layer is then applied to the outer circumference of the polyurethane layer and after which time the roller is further machined on a lathe to size to a desired outer diameter. Following sizing, a layer of nickel paint is applied over the ceramic coating layer. Copper is then plated directly onto the nickel painted layer. The copper layer is engraved with an image, after which a final protective chrome layer is applied over the image-carrying copper layer.

The applicant has appreciated that in applying a nickel painted layer, surface defects and surface thickness variations often lead to defects in the quality of prints made by cylinders refurbished by this process. In particular, as a result of the painting process, the thickness of the nickel paint layer is typically not uniform across the ceramic coating layer. In addition, surface scratches often arise in the nickel layer during handling of the cylinders. These defects affect the quality of the electroplated copper layer and subsequently result in inferior quality printings. Additionally, resizing requires the cylinder to be returned directly to the manufacturer, where the coating layers including the nickel paint layer must be reapplied using specialized equipment.

SUMMARY OF THE INVENTION

It is therefore an objective of the present invention to provide an improved refurbished cylinder roller and a process for refurbishing cylinder rollers, which for example may be used in printing applications, and which overcome the difficulties noted above.

Another objective of the present invention is to provide a refurbishing process which allows for increasing the finished outer diameter of a cylinder roller, and more preferable increasing the finished outer diameter of a gravure cylinder roller or base.

Another objective of the present invention is to provide a refurbishing process where existing chrome and copper plating finishing methods and equipment can be used on a gravure cylinder roller having a metallic core supporting an intermediate electrically conductive polymer layer.

Another objective of the present invention is to provide a more versatile cylinder roller which has an outer diameter that can be more readily resized for new use applications by common practices in the industry without the need for specialized equipment.

In one aspect of the present invention, there is provided a refurbished cylinder roller which includes a metallic core, an intermediate electrically conductive polymer layer, an image-carrying metallic layer, and preferably a further protective outer metallic layer.

In yet a further aspect of the present invention, there is provided a refurbished printing roller for use in a printing process, said roller comprising: a core member configured for mounting the printing roller in a printing machine, said core member having an axial length and comprising an outer peripheral core surface extending along said axial length, at least a portion of said outer core surface being roughened to a surface roughness between 150 to 500 Ra; an electro-plated metallic image-carrying layer arranged circumferentially about the outer core surface along at least a portion of said axial length, said image-carrying layer comprising a polished outer peripheral printing surface, said printing surface comprising a printing image, wherein said printing image is selected from one of engraved and etched into said image-carrying layer; an intermediate layer arranged between said outer core surface and said image-carrying layer, said intermediate layer comprising an extruded and thermally cured conductive polymer material, said polymer material comprising an effective amount of granular graphite particles, conductive black and carbon black to permit electro-plating of said polymer material; wherein said intermediate layer further comprises a polished outer peripheral intermediate surface having a surface roughness between 10 to 30 Ra, and wherein said image-carrying layer being electro-plated directly onto said intermediate surface; a binder layer arranged between said outer core surface and said intermediate layer; and an electro-plated metallic outer protective layer arranged circumferentially about the printing surface, said protective layer being electro-plated directly over said image-carrying layer.

In yet a further aspect of the present invention, there is provided a gravure printing roller for use in a printing process, said roller comprising: a core member having an axial length and configured for mounting the printing roller in a printing machine, said core member comprising an outer peripheral core surface; an image-carrying layer arranged circumferentially about the core surface along at least a portion of said axial length, said image-carrying layer comprising a concentric printing surface having a printing image formed therein, an intermediate polymer material layer arranged between the core surface and the image-carrying layer, said intermediate polymer material layer having a conductivity selected to permit electro-plating; wherein said image-carrying layer being electro-plated directly onto said intermediate polymer material layer; an outer protective layer arranged circumferentially about the image-carrying layer, wherein said protective layer being plated over said printing surface.

In yet a further aspect of the present invention, there is provided a refurbished printing roller for use in a printing process, said roller comprising: a core member configured for mounting the printing roller in a printing machine, said core member having an axial length and comprising an outer peripheral core surface extending along said axial length, at least a portion of said outer core surface being roughened to a surface roughness between 150 to 500 Ra; an electro-plated metallic image-carrying layer arranged circumferentially about the outer core surface along at least a portion of said axial length, said image-carrying layer comprising a polished outer peripheral printing surface, said printing surface comprising a printing image, wherein said printing image is selected from one of engraved and etched into said image-carrying layer; an intermediate layer arranged between said outer core surface and said image-carrying layer, said intermediate layer comprising an extruded and thermally cured conductive polymer material, said polymer material comprising an effective amount of granular graphite particles and conductive black to permit electro-plating of said polymer material; wherein said intermediate layer further comprises a polished outer peripheral intermediate surface having a surface roughness between 10 to 30 Ra, and wherein said image-carrying layer being electro-plated directly onto said intermediate surface; and an electro-plated metallic outer protective layer arranged circumferentially about the printing surface, said protective layer being electro-plated directly over said image-carrying layer.

In a further aspect of the present invention, there is provided a process for refurbishing cylinder rollers by curing an electrically conductive intermediate polymer layer directly onto a metallic core of a cylinder roller, and there after applying an image-carrying copper layer directly onto the intermediate layer.

In yet a further aspect of the present invention, there is provided a process for refurbishing a cylinder roller or printing roller by applying a conductive intermediate layer directly onto a metallic core of the cylinder roller; further applying an image-carrying metallic layer directly onto the intermediate layer; and thereafter applying a protective outer metallic layer.

In yet another aspect of the present invention, there is provided a preferred process whereby the outer chrome and copper layers of a printing cylinder roller are removed from the metallic core of the cylinder roller by precision machining The metallic core is then sand blasted, belt sanded or rough turned to roughen or coarsen the outer surface of the metallic core, after which the surface is cleaned to remove any dirt, oil or debris. Following cleaning, a mixture of a hydrocarbon based solvent and a polymer based material is applied to the core surface, after which an electrically conductive intermediate polymer layer is extruded onto the metallic core at a desired radial thickness. To maintain the dimensional stability of the extruded intermediate layer, shrink tape is applied under tension around the circumference of the extruded intermediate layer which is subsequently thermally cured. After curing, the shrink tape is removed from the intermediate layer, following which the intermediate layer is grinded to a desired radial diameter. After grinding, copper is then electroplated onto the intermediate layer. The copper layer is engraved with an image, after which a final protective chrome layer is applied over the image-carrying copper layer.

In yet another preferred aspect of the present invention, there is provided a process for refurbishing a used gravure printing roller having a cylindrical core member extending along an axial length and having an outer printing layer plated thereon, the method comprising the steps of: removing the outer printing layer from the core member to expose a cylindrical outer peripheral core surface having a surface roughness between 150 to 500 Ra, said step of removing being selected from precision machining, precision grinding and manual grinding; applying by one of brushing, spraying and pouring a binder layer having a radial thickness of less than 5 mm onto said outer core surface; applying circumferentially about said binder layer a concentric conductive intermediate polymer material layer having a radial thickness between 5 mm to 100 mm; said intermediate polymer material layer comprising an effective amount of graphite particles, carbon black and conductive black to permit electro-plating of said intermediate polymer material layer; curing said intermediate polymer material layer, said step of curing comprising curing parameters selected from a temperature range between 250 to 400 degrees Fahrenheit, a pressure range between 60 to 100 psi and a curing time between 4 to 12 hours; finishing said cured intermediate polymer material layer, said step of finishing comprising sizing said cured intermediate polymer material layer to a pre-selected diameter; and forming a concentric outer peripheral intermediate surface having a surface roughness between 10 to 30 Ra; electro-plating an image-carrying layer directly onto said outer intermediate surface, said image-carrying layer defining an outer printing surface; forming a printing image in said printing surface, said step of forming selected from one of engraving and etching into said printing surface; plating a protective outer layer over said printing surface.

Further aspects of the invention will become apparent upon reading the following detailed description and drawings, which illustrate the invention and preferred embodiments of this invention.

BRIEF DESCRIPTION OF THE DRAWINGS

Reference may now be had to the following detailed description taken together with the accompanying drawings in which:

FIG. 1B shows an enlarged view of the encircled portion of FIG. 1A.

FIG. 3A shows a perspective side view of a used conventional cylinder roller.

FIG. 3B shows a lateral cross-sectional view of the used cylinder roller of FIG. 3A taken along section Y-Y.

FIG. 3C shows an enlarged view of the encircled portion of FIG. 3B.

FIG. 4A shows in cross-sectional view of the outer core surface of the cylinder roller of FIG. 3A after removal of the worn outer plating layer in accordance with the present invention.

FIG. 4B shows an enlarged view of the encircled portion of FIG. 4A.

FIG. 5A shows in cross-sectional view the cylinder roller of FIG. 4A having a binder layer applied thereon.

FIG. 5B shows an enlarged view of the encircled portion of FIG. 5A.

DETAILED DESCRIPTION OF THE DRAWINGS

Figure 1A:
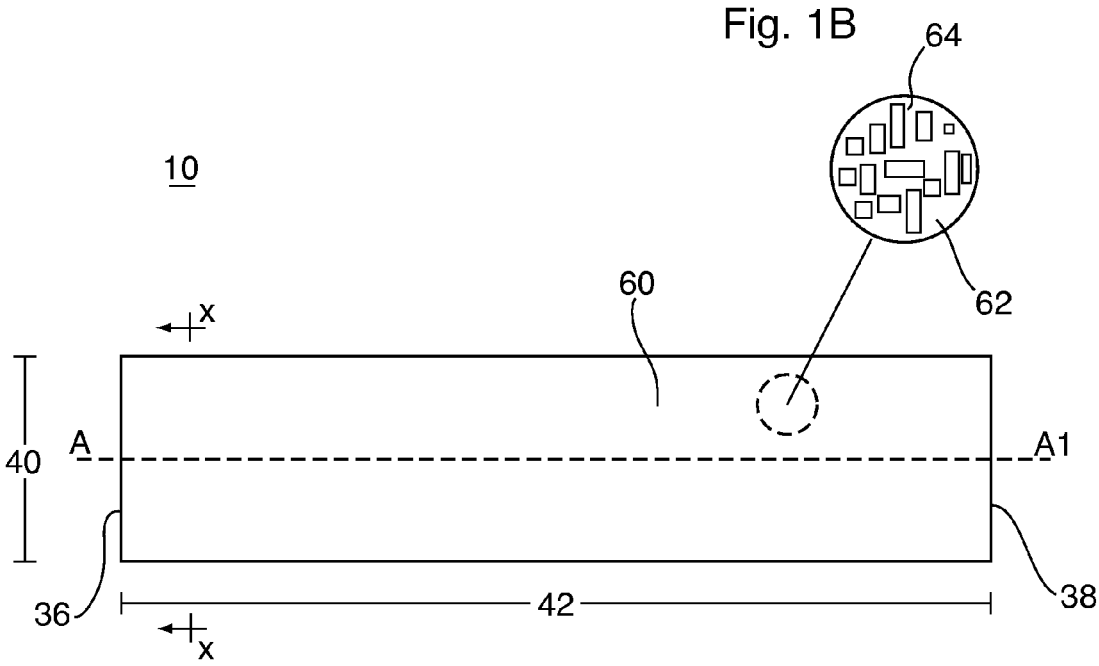
FIG. 1A shows a perspective side view of a refurbished cylinder roller in accordance with the present invention.

Reference is made to FIG. 1A which shows a perspective side view of a refurbished gravure cylinder roller 10 extending from a first end 36 to a second end 38 along an axis A-A1. Preferably, the cylinder roller 10 has a lateral cross-sectional diameter 40 ranging from 50 mm to 1000 mm and an axial length 42 ranging from 100 mm to 7000 mm. As will be more fully described below, the cylinder roller 10 includes a hollow cylindrical steel core 12, a binder layer 14, an intermediate polymer layer 16 and a plating layer 60 each concentrically positioned about the axis A-A1 and extending from the first end 36 to the second end 38.

As will be more fully described below and best shown in the enlarged view of FIG. 1B, the outermost radial circumference of the cylinder roller 10 includes a polished outer peripheral printing surface 62 having a printing image formed therein as a collection of tiny cells 64 of varying distribution and depth which determine the lightness/darkness of the particular image to be printed. In use, the cylinder roller 10 rotates about its axis A-A1 in an ink fountain and collects ink within the cells 64. Through rotation of the cylinder roller 10 and the application of pressure of the printing surface 62 against a substrate, the ink is transferred to the surface of the substrates to form the printed image.

Figures 2A, 2B:
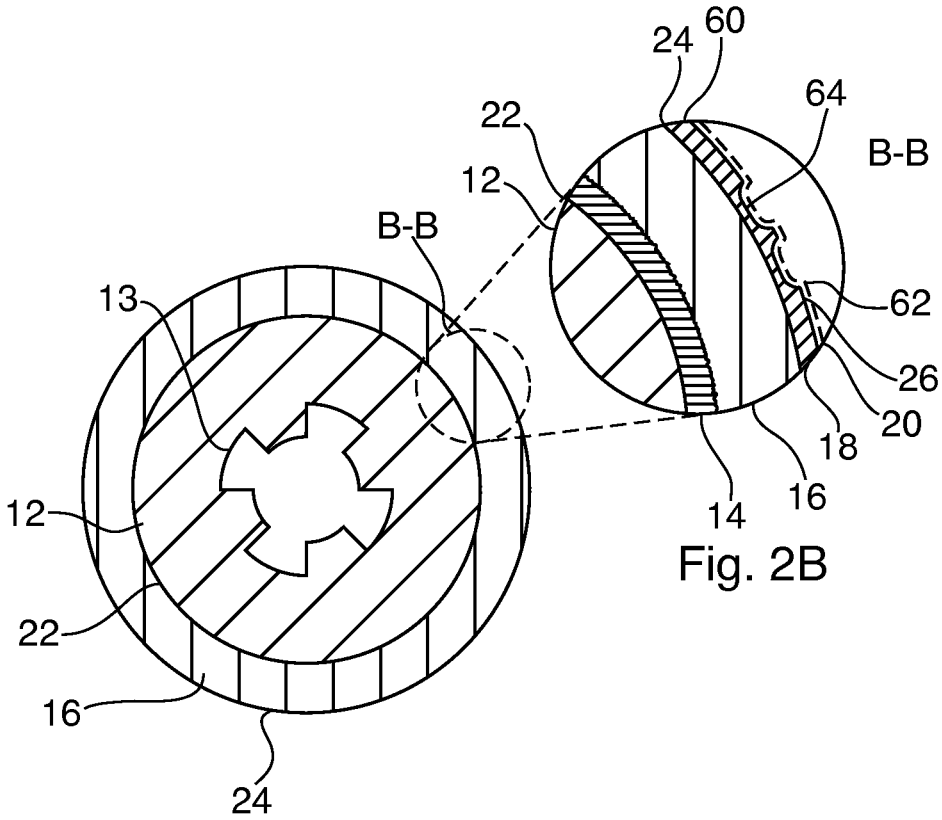
FIG. 2A shows a lateral cross-sectional view of the cylinder roller of FIG. 1 taken along section X-X.
FIG. 2B shows an enlarged view of the encircled portion of FIG. 2A.

Reference will now be made to FIG. 2A which shows a lateral cross-sectional view taken at one end of the cylinder roller 10 shown in FIG. 1A along the section X-X. The cylinder roller 10 includes a hollow cylindrical steel core 12 formed concentrically about the axis A-A1 and which extends radially outwardly to an outermost concentric core surface 22. Preferably the core 12 has a radial diameter ranging from 50 mm to 1000 mm, and more preferably 150 mm to 750 mm. The core surface 22 is preferably machined or ground to have a roughness of about 150 to 500 Ra and more preferably about 250 to 350 Ra. The core surface 22 may also preferably be roughened by chemically etching, sand blasting, belt sanding or any like process to coarsen the core surface 22 to a selected roughness.

The core 12 also preferably includes a keyed interface 13 which is configured to receive a keyed shaft (not shown) of a printing machine for mounting the cylinder roller 10 in a printing machine or printing press. In an alternative embodiment, the core 12 may be provided as an elongated solid cylindrical shaft having formed integrally therewith shaft ends configured for mounting the cylinder roller 10 in a printing machine or printing press.

As more fully shown in the exploded view of FIG. 2B, formed concentrically about the radial periphery of the core surface 22 is a binder layer 14, an intermediate polymer layer 16 and a plating layer 60 which includes an image-carrying copper layer 18 and a protective chrome layer 20.

The binder layer 14 is disposed directly over the core surface 22 and preferably has a thickness no greater than 5 mm and more preferably a thickness of about 2 mm. The binder layer is selected to enhance bonding between the intermediate polymer layer 16 and the core surface 22. The binder layer 16 may be a commercially available adhesive product which enhances bonding between metal and rubber materials, such as commercially available under the trade-mark Chemlok EP 6804-22 from LORD Chemical products.

In a more preferred construction, the binder layer 14 consists of a mixture including a suitable hydrocarbon based solvent, such as toluene, and a polymer based material, such as the intermediate polymer layer 16 material which is more fully described below. Preferably the mixture is in a ratio of 5 to 25 parts polymer with the remaining being solvent.

Formed concentrically about the axis A-A1 and disposed directly over the binder layer 16 is an intermediate polymer layer 16 which extends radially outwardly to an outermost concentric intermediate surface 24 to form a supportive underlying layer for the plating layer 60. The radial thickness of the intermediate polymer layer 16 depends on the desired diameter of the cylinder roller 10 and most typically within a range from 5 mm to 100 mm, and more preferably 10 mm to 50 mm. Preferably, the intermediate surface 24 is substantially blemish free and has a smooth surface finish. Preferably the intermediate surface 24 has a surface roughness of about 10 to 30 Ra, and more preferably between 15 to 25 Ra.

The intermediate polymer layer 16 is formed from an electrically conductive polymer material which preferably incorporates electrically conductive particles or elements into its final composition which allows for sufficient conductivity to enable electroplating of the plating layer 60. For example, the polymer layer 16 may preferably include graphite, conductive black, carbon black, powdered copper, copper flakes or powdered nickel into its final composition as more fully described below. The intermediate polymer layer 16 has an electrical resistance below 1500Ω, preferably below 1000Ω and more preferably below 500Ω to allow for direct electroplating thereon. The intermediate polymer layer 16 has a surface hardness between about 50 to 90 Durometer Shore D and more preferably between 70 to 80 Durometer Shore D.

The electrically conductive intermediate polymer layer 16 may preferably include 80 to 120 parts per hundred resin of nitrile rubber, such as commercially available under the trade-mark NBR 3350 to Petroflex and trade-mark Nitriflex 615B to Struktol-US. The polymer layer 16 may also preferably include 80 to 120 parts per hundred resin of nitrile rubber, natural rubber, Styrene Butadiene rubber ("SBR" rubber) or combinations thereof. Alternatively the polymer layer may include a polymer blend which preferably includes a ratio of 65 to 99 parts nitrile rubber, natural rubber and SBR rubber to 1 to 35 parts polyvinylchloride.

The intermediate polymer layer 16 also includes 10 to 50 parts per hundred resin of conductive particles such as graphite, copper flakes, powdered copper or powdered nickel, 25 to 60 parts per hundred resin of carbon black and 20 to 70 parts per hundred resin of conductive black. The intermediate polymer layer 16 may also preferably include other commercially available rubber additives to assist in vulcanization and which are know in the rubber making industry, such as vulcanizing agents, rubber antioxidants, rubber accelerators, tackifiers, plasticizers and fatty acid esters.

In a preferred construction the rubber additives include 2 to 50 parts per hundred resin of a vulcanizing agent such as sulfur, 1 to 8 parts per hundred resin of a rubber antioxidant such as polymerized 1,2-dihydro-2,2,4-trimethylquinoline "TMQ" available from Sunboss Chemicals under the trade-name TMQ, 0.25 to 8 parts per hundred resin of rubber accelerators selected from the group consisting of mercapto benzo thiazole disulfide "MBTS" available from Sunboss Chemicals under the trade-name MBTS, zinc oxide, stearic acid and zinc stearate, and 5 to 30 parts per hundred resin of tackifiers and plasticizers which include triethylene glycol bis(2-ethylhexanoate) available under the trade-mark plasticizer SC-E available from Struktol-US, amber flakes, Koresin™ available from Struktol-US, talc powder (silicate), fatty acid esters such as aliphatic fatty acid esters, aromatic resin and woodrosin resin.

The electrically conductive intermediate polymer layer 16 may also preferably include acrylonitrile rubber in an amount ranging from 80 to 120 parts per hundred resin and more preferably 100 parts per hundred resin; zinc oxide in an amount ranging from 4 to 6 parts per hundred resin and more preferably 5 parts per hundred resin; fatty acid ranging from 1.2 to 1.8 parts per hundred resin and more preferably 1.5 parts per hundred resin; antioxidant-dihydromethyl quiniline in an amount ranging from 1.6 to 2.4 parts per hundred resin and more preferably 2.0 parts per hundred resin; mineral graphite powder ranging from 16 to 24 parts per hundred resin and preferably 20 parts per hundred resin; mineral sulphur in an amount ranging from 10 to 25 parts per hundred resin and preferably 15 parts per hundred resin; and mercaptobezothirum sulphide ranging from 0.4 to 0.6 parts per hundred resin and more preferably 0.5 parts per hundred resin. The intermediate polymer layer 16 may also optionally include tetra methyl thirum disulphide ranging from 1.0 to 1.6 parts per hundred resin and more preferably 1.3 parts per hundred resin.

By way of non-limiting preferred sample examples only, below please find Tables 1 to 6 which show preferred compositions of the intermediate polymer layer 16 which have been applied in the present invention, and which includes the commercially description of the constituents.

TABLE 1

| COMMERCIAL DESCRIPTION | CHEMICAL DESCRIPTION | PPHR (parts per hundred resin) |
|---|---|---|
| NITRILE RUBBER | ARCYLONITRILE RUBBER | 100.00 |
| STRUKTOL WB 222 | FATTY ACID | 2.00 |
| KADOX 911 C | ZINC OXIDE | 5.00 |
| STEARIC ACID | FATTY ACID | 1.50 |
| AGERITE RESIN D | ANTIOXIDANT-DIHYDRO-METHYL QUINILINE | 2.00 |
| RESIN 56 HPA | FATTY ACID | 10.00 |
| CARBON BLACK XC 72 | CONDUCTIVE BLACK | 30.00 |
| GRAPHITE 425 | MINERAL GRAPHITE POWDER | 20.00 |
| PLASTICIZER SC | TRIETHYLENE GLYCOL | 20.00 |
| SULPHUR | MINERAL SULPHUR | 15.00 |
| MBTS | MERCAPTOBEZOTHIRUM-SULPHIDE | 0.50 |

TABLE 2

| COMMERCIAL DESCRIPTION | CHEMICAL DESCRIPTION | PPHR (parts per hundred resin) |
|---|---|---|
| NITRILE RUBBER | ARCYLONITRILE RUBBER | 100.00 |
| STRUKTOL WB 222 | FATTY ACID | 2.00 |
| KADOX 911 C | ZINC OXIDE | 5.00 |
| STEARIC ACID | FATTY ACID | 1.5 |

TABLE 2-continued

| COMMERCIAL DESCRIPTION | CHEMICAL DESCRIPTION | PPHR (parts per hundred resin) |
|---|---|---|
| AGERITE RESIN D | ANTIOXIDANT-DIHYDRO-METHYL QUINILINE | 2.00 |
| BLACK N 330 | CARBON BLACK | 60.00 |
| GRAPHITE 425 | MINERAL GRAPHITE POWDER | 30.00 |
| PLASTICIZER SC | TRIETHYLENE GLYCOL | 15.00 |
| SULPHUR | MINERAL SULPHUR | 15.00 |
| MBTS | MERCAPTOBEZOTHIRUM-SULPHIDE | 0.50 |

TABLE 3

| COMMERCIAL DESCRIPTION | CHEMICAL DESCRIPTION | PPHR (parts per hundred resin) |
|---|---|---|
| NITRILE RUBBER | ARCYLONITRILE RUBBER | 100.00 |
| STRUKTOL WB 222 | FATTY ACID | 2.00 |
| KADOX 911 C | ZINC OXIDE | 5.00 |
| STEARIC ACID | FATTY ACID | 1.50 |
| AGERITE RESIN D | ANTIOXIDANT-DIHYDRO-METHYL QUINILINE | 2.00 |
| BLACK N 330 | CARBON BLACK | 60.00 |
| GRAPHITE 425 | MINERAL GRAPHITE POWDER | 20.00 |
| PLASTICIZER SC | TRIETHYLENE GLYCOL | 10.00 |
| SULPHUR | MINERAL SULPHUR | 15.00 |
| MBTS | MERCAPTOBEZOTHIRUM-SULPHIDE | 0.50 |

TABLE 4

| COMMERCIAL DESCRIPTION | CHEMICAL DESCRIPTION | PPHR (parts per hundred resin) |
|---|---|---|
| PARACRIL OZO (NBR/PVC 70/30 ML 50) | POLYVINLY CHLORIDE MODIFIED NITRILE RUBBER | 100.00 |
| STRUKTOL WB 222 | FATTY ACID | 2.00 |
| KADOX 911 C | ZINC OXIDE | 5.00 |
| STEARIC ACID | FATTY ACID | 1.50 |
| AGERITE RESIN D | ANTIOXIDANT-DIHYDRO-METHYL QUINILINE | 2.00 |
| BLACK N 330 | CARBON BLACK | 40.00 |
| CARBON BLACK XC 72 | CONDUCTIVE BLACK | 30.00 |
| GRAPHITE 425 | MINERAL GRAPHITE POWDER | 20.00 |
| PLASTICIZER SC | TRIETHYLENE GLYCOL | 20.00 |
| SULPHUR | MINERAL SULPHUR | 25.00 |
| MBTS | MERCAPTOBENZ-THIAZOLE DISULFIDE | 0.50 |

TABLE 5

| COMMERCIAL DESCRIPTION | CHEMICAL DESCRIPTION | PPHR (parts per hundred resin) |
|---|---|---|
| PARACRIL OZO (NBR/PVC 70/30 M58) | PRE-FLUXED BLEND OF NITRILE RUBBER AND POLY-VINLY CHLORIDE BLEND | 100.00 |
| STRUKTOL WB 222 | ALIPHATIC FATTY ACID ESTERS PLASTICIZER | 2.00 |
| ZINC OXIDE | ZINC OXIDE | 5.00 |
| STEARIC ACID | FATTY ACID | 1.50 |
| AGERITE RESIN D | POLYMERIZED 1,2-DIHYDRO-2,2,4-TRIMETHYLQUINOLINE | 2.00 |
| CARBON BLACK N 330 | CARBON BLACK | 40.00 |
| CARBON BLACK XC 72 | CONDUCTIVE BLACK | 30.00 |

TABLE 5-continued

| COMMERCIAL DESCRIPTION | CHEMICAL DESCRIPTION | PPHR (parts per hundred resin) |
|---|---|---|
| GRAPHITE 729 | MINERAL GRAPHITE POWDER | 20.00 |
| PLASTICIZER SC | TRIETHYLENE GLYCOL BIS (2-ETHYLHEXANOATE) | 20.00 |
| RUBBER MAKER'S SULPHUR | MINERAL SULPHUR | 25.00 |
| MBTS | ACCELERATOR-MERCAPTO-BENZTHIAZOLE DISULFIDE | 0.50 |

TABLE 6

| COMMERCIAL DESCRIPTION | CHEMICAL DESCRIPTION | PPHR (parts per hundred resin) |
|---|---|---|
| NBR 3350 (Petroflex) | NITRILE RUBBER | 100.00 |
| ZINC OXIDE | ZINC OXIDE | 5.00 |
| STEARIC ACID | STEARIC ACID | 1.0 |
| TMQ/AGERITE RESIN D | POLYMERIZED 1,2-DIHYDRO-2,2,4-TRIMETHYLQUINOLINE | 2.0 |
| N472 | CONDUCTIVE BLACK | 50.00 |
| GRAPHITE 729 | MINERAL GRAPHITE POWDER | 20.00 |
| TALC POWDER | SILICATE | 10.00 |
| CUMAR 100/ AROTAC 100 | RESIN-AMBER FLAKES | 10.00 |
| KORESIN-STRUCKTOL-US | RESIN | 5.0 |
| MBTS | ACCELERATOR-MERCAPTO-BENZTHIAZOLE DISULFIDE | 0.50 |
| RUBBER MAKER'S SULPHUR | MINERAL SULPHUR | 25.00 |

The plating layer 60 is disposed directly over the intermediate surface 24 and preferably has a thickness between 0.1 mm to 1.6 mm, and more preferably 0.15 mm to 1 mm. The plating layer 60 includes an image-carrying copper layer 18 and an outer protective chrome layer 20. The thickness of the copper layer 18 may preferably ranges from 0.07 mm to 1.5 mm and preferably includes a substantially blemish free and polished smooth outer copper surface 26. The image-carrying copper layer 18 includes therein the cells 64 which form the image to be printed on the substrate. Preferably, a thin polished protective layer of chrome 20 is provided over the copper surface 26. Preferably the chrome protective layer has a thickness of about 0.005 to 0.05 mm, and more preferably 0.008 mm thick.

Although this disclosure has described and illustrated the cylindrical core 12 being formed of steel and the plating layer 60 as including copper and chrome plating layers, it is also to be understood that the invention is not restricted to these particular embodiments. Rather, any suitable metallic core and plating materials which are used in the printing industry are equally applicable with the present invention. Furthermore, it is to be understood that while various commercially available products have been identified as components of the present invention, it is to be understood that the present invention is not restricted to these particular embodiments, as would be readily understood by a skilled artesian in the art.

Refurbishing Process

The present invention provides a new process for refurbishing used and worn conventional cylinder rollers for re-use in new printing applications.

Removal of Worn Plating Layers

FIGS. 3A, 3B and 3C show respectively a side perspective view, a cross-sectional view and an enlarged view of a used conventional cylinder roller 114 having a cylindrical steel core 112 extending from a first end 90 to a second end 92 along an axis A2-A3. The core 112 has electroplated directly thereon outer plating layers 113 about its radial circumference along its axial length. During printing with cylinder roller 114, the outer plating layers 113 on the cylinder roller 112 wear, and in return print quality begins to deteriorate. Additionally, after a printing run, the use for the particular cylinder roller 114 becomes obsolete, resulting in a large number of obsolete printing rollers being stored by printers.

The used cylinder roller 114 may be refurbished by first removing the worn outer plating layers 113 and a portion of the outer radial periphery of the core 112 along its entire axial length. To remove the worn outer plating layer 113 and the outer radial periphery of the core 112, the cylinder roller 114 preferably is placed in a turning lathe and machined along its axial length about its outer circumference. It is to be appreciated that alternatively, the cylinder roller 114 may be manually or machine ground in a grinding process to precision grind the outer radial periphery of the core 112 and remove the outer plating layer 112. The cylinder roller 114 is machined to completely remove the worn plating layer 113 along the entire axial length of the core 112 and at least to a depth of 0.1 mm into the core 112, and more preferably 10 mm into the core 112. Most preferably, the cylinder roller 114 may be machined or ground to reduce the outer radial periphery of the core 112 to a pre-selected desired radial diameter forming a new cylindrical core 12 about the axis A2-A3 and which extends radially outwardly to an outermost concentric core surface 22.

Roughening Core Surface

After machining, the core surface 22 of the core 12 may be roughed preferably by chemically etching, sand blasting, belt sanding or any like process to coarsen the core surface 22 of the core 12. Preferably, the core surface 22 is roughened to about 150 to 500 Ra and more preferably to 250 to 350 Ra.

Cleaning

After roughening, the roughened core surface 22 is cleaned to remove any oil, dirt or debris. Preferably, the roughened core surface 22 is cleaned using a suitable solvent, such as toluene, to remove any oil and/or dirt. In alternative embodiments, cleaning may be completed manually or automated by machine. FIGS. 4A and 4B shows a cross-sectional view of the cylindrical core 12 and the core surface 22.

Application of Binder Layer

Following cleaning, a semi-liquid or liquid binder layer 14 is applied directly over the cleaned core surface 22. In a simplified construction, the binder layer is a commercially available adhesive which enhances bonding between metal and rubber components such as available under the trademark Chemlok EP6804-22 available from LORD Chemical Products. Alternatively, the binder layer 14 may consists of a mixture including a suitable hydrocarbon based solvent and a polymer based material. Preferably, the mixture is mixed at room temperature and permitted to stand for about 24 to 48 hours so that the polymer has sufficient time to dissolve within the solvent. After the polymer has sufficiently dissolved into the solvent, the binder layer 14 may be applied over the entire axial length of the ground core surface 22 by brushing, spraying or pouring a thin layer to coat the core surface 22. After application of the binder layer 14 to the core surface 22, the layer is allowed to dry for a period of 24 to 48 hours to allow for the binder layer to harden forming a pre-coated core 120, as best seen in FIGS. 5A and 5B respectively.

Extrusion

After the drying and hardening of the binder layer 14, the pre-coated core 120 is transferred to an extrusion apparatus.

An electrically conductive intermediate polymer layer 16 is extruded over the binder layer 14 evenly about the pre-coated core 120 along the axial length of the core 12. In the extrusion process, the polymer material is heated to about 150° to 300° C. and is pushed or drawn through a thin strip die to extrude the polymer material into thin strips. In the extrusion process the pre-coated core 120 is rotated about it's axis on an extrusion lath and the polymer extruded strips are wound circumferentially about the pre-coated core 120 from one end of the core 12 to the other end to form the extruded intermediate polymer layer 16 about the pre-coated core 120. Preferably, the intermediate polymer layer 16 is applied under pressure of about 70 to 90 psi.

Sizing

Before curing the extruded intermediate polymer layer 16, to ensure dimensional stability shrink tape, such as mylar shrink tape or nylon shrink tape, is applied under tension around the outer peripheral surface of the uncured extruded intermediate polymer layer 16. Once the shrink tape has been applied to the intermediate surface 24 of the intermediate polymer layer 16, the extruded cylinder is removed from the extrusion apparatus and placed in an autoclave for curing.

Thermal Curing

Depending on the length and thickness of the intermediate polymer layer 16, the extruded cylinder is cured at a given temperature and time in an autoclave. Curing may occur at about 250° C. to 400° F. under pressure of about 60 to 100 psi for about four to twelve hours. However, curing times and temperature will depend on the thickness of the core 12, thickness of the intermediate polymer layer 16, length of the cylinder roller and the number of cylinders being cured in the autoclave. It is to be understood that the curing conditions would be readily understood by someone skilled in the art. Preferably, after curing, the intermediate polymer layer 16 has a Durometer Shore D hardness of about 50 to 90 and more preferably between 70 to 80.

Grinding/Sizing

Figures 6A, 6B:
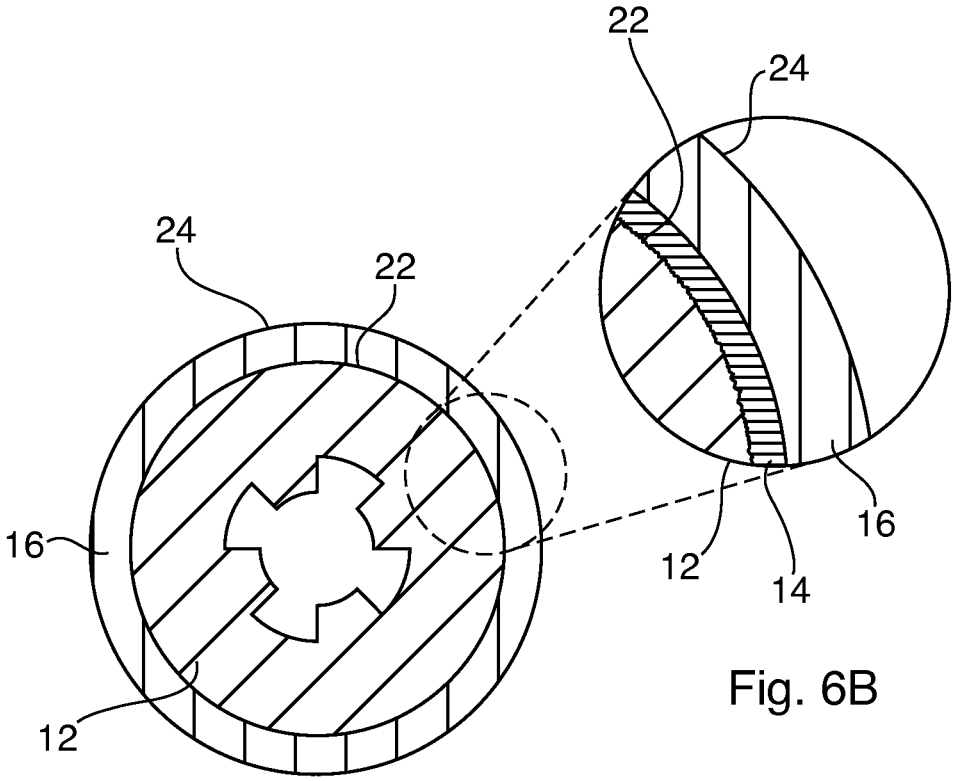
FIG. 6A shows in cross-sectional view the cylinder roller of FIG. 5A having an intermediate polymer layer applied thereon.
FIG. 6B shows an enlarged view of the encircled portion of FIG. 6A.

After the intermediate polymer layer 16 has cured, the cured cylinder is transferred to a cylinder lathe apparatus for rough grinding. The intermediate surface 24 of the intermediate polymer layer 16 and end faces and of the cured cylinder are machined to remove the shrink tape. After removal of the shrink tape, the roughened cylinder is transferred to a cylinder grinder apparatus for final surface grinding. Preferably, the grinding apparatus grinds and polishes the intermediate surface 24 of the intermediate polymer layer 16 to a desired diameter size and a substantially blemish free smooth surface, as best shown in FIGS. 6A and 6B respectively. Preferably, the intermediate surface 24 is polished to about 10 to 30 Ra.

Copper Plating

After grinding and polishing the intermediate surface 24 of the intermediate polymer layer 16, the electrical conductivity of the intermediate polymer layer 16 allows for a copper layer 18 to be directly plated onto the intermediate polymer layer 16 by directly applying an electric current to the intermediate polymer layer 16. The conductive particles in the polymer layer 16 allows for a secure bond between the polymer layer 16 and the copper layer 18. After plating, the outer radial peripheral surface of the copper layer 18 may be ground to a desired size, if necessary. Polishing and smooth finishing operations are applied to the copper layer to ensure that inaccuracies inherent in the copper plating procedure are compensated for.

Engraving

After copper plating and polishing, the copper layer 18 is embossed, engraved or etched with an image to be printed. Preferably, the image is formed into the copper layer 18 so that the image comprises a plurality of tiny cells 64 which do not extend to the intermediate polymer layer 16, the distribution and depth of which determine the lightness/darkness of the particular image area.

Chrome Plating

As best shown in FIGS. 2A and 2B, to impart an added degree of protection and to lower the coefficient of friction which results in an increased cylinder life cycle, preferably a thin layer of chrome 20, preferably about 0.005 to 0.05 mm thick, most preferably 0.008 mm thick, is electroplated on top of the image-carrying copper layer 18. In a final step, the chrome layer 20 is polished to a smooth finish. Reference may now be had to FIGS. 2A and 2B respectively which show the refurbished cylinder roller 10 in accordance with the present invention Although this disclosure has described and illustrated certain preferred embodiments of the present invention, it is also to be understood that the invention is not restricted to these particular embodiments. In an alternative embodiment, the intermediate polymer layer 16 may be provided in calendar sheet form and applied manually about the core surface 22. In this embodiment, the intermediate polymer layer 16 is provided in calendar sheet form having a desired thickness and a width substantially corresponding to the axial length of the core 12. Preferably, the calendar sheet may be manually wrapped circumferentially about the core surface 22 under tension. Additionally, a commercially available binder layer to enhance metallic to rubber bonding may be applied in the present invention without departing from the scope of the present invention.

We claim:

1. A process for refurbishing a used gravure printing roller having a cylindrical core member extending along an axial length and having an outer printing layer plated thereon, the method comprising the steps of:

removing the outer printing layer from the core member to expose a cylindrical outer peripheral core surface having a surface roughness between 150 to 500 Ra, said step of removing being selected from precision machining, precision grinding and manual grinding;

applying by one of brushing, spraying and pouring a binder layer having a radial thickness of less than 5 mm onto said outer core surface;

applying circumferentially about said binder layer a concentric conductive intermediate polymer material layer having a radial thickness between 5 mm to 100 mm; said intermediate polymer material layer comprising an effective amount of conductive particles to permit electro-plating of said intermediate polymer material layer;

curing said intermediate polymer material layer, said step of curing comprising curing parameters selected from a temperature range between 250 to 400 degrees Fahrenheit, a pressure range between 60 to 100 psi and a curing time between 4 to 12 hours;

finishing said cured intermediate polymer material layer, said step of finishing comprising sizing said cured intermediate polymer material layer to a pre-selected diameter; and forming a concentric outer peripheral intermediate surface having a surface roughness between 10 to 30 Ra;

electro-plating an image-carrying layer directly onto said outer intermediate surface, said image-carrying layer defining an outer printing surface;

forming a printing image in said printing surface, said step of forming selected from one of engraving and etching into said printing surface;

plating a protective outer layer over said printing surface.

2. The process according to claim 1, wherein said step of removing comprises sizing the outer core surface to a pre-selected outer diameter; and wherein said step of applying said intermediate polymer material layer being selected from extruding said intermediate polymer material layer circumferentially about said binder layer and wrapping circumferentially about said binder layer a calendar sheet consisting of said intermediate polymer material layer.

3. The process according to claim 1 wherein said intermediate polymer material layer comprises a hardness between 70 to 90 Durometer Shore D;

10 to 40 parts per hundred resin of said granular graphite particles;

25 to 60 parts per hundred resin of said carbon black; and 25 to 50 of said parts per hundred resin conductive black.

4. The process according to claim 3 wherein the intermediate polymer material layer further comprises:

80 to 120 parts per hundred resin of a polymer blend comprising rubber and polyvinylchloride, wherein said polymer blend comprises a ratio of 65 to 99 parts nitrile rubber to 1 to 35 parts polyvinylchloride.

5. The process according to claim 4, wherein the intermediate polymer material layer further comprises rubber additives, said additives selected from the group consisting of vulcanizing agents, rubber antioxidants, rubber accelerators, plasticizers and fatty acid esters.

6. The process according to claim 4, wherein said intermediate polymer material layer further comprises 10 to 40 parts per hundred resin of sulfur;

2.5 to 10 parts per hundred resin of zinc oxide;

0.5 to 5 parts per hundred resin of stearic acid;

1 to 8 parts per hundred resin of rubber antioxidants comprising polymerized 1,2-dihydro-2,2,4-trimethylquinoline "TMQ";

0.25 to 3 parts per hundred resin of rubber accelerators comprising mercaptobenzthiazole disulfide "MBTS"; and 20 to 45 parts per hundred resin of rubber tackifiers.

* * * * *